US005873510A

United States Patent [19]

Hirai et al.

[11] Patent Number: 5,873,510

[45] Date of Patent: Feb. 23, 1999

[54] REPETITIVE STRIKING TYPE PNEUMATICALLY OPERATED NAIL GUN

[75] Inventors: Shoichi Hirai; Yoshinori Ishizawa; Masanori Aoki, all of Hitachinaka, Japan

[73] Assignee: Hitachi Koki Co., Ltd., Tokyo, Japan

[21] Appl. No.: 847,358

[22] Filed: Apr. 24, 1997

[30] Foreign Application Priority Data

May 10, 1996 [JP] Japan ..... 8-116412

[51] Int. Cl.[6] ..... B25C 1/04

[52] U.S. Cl. ..... 227/130; 227/8

[58] Field of Search ..... 227/8, 130, 10

[56] References Cited

U.S. PATENT DOCUMENTS

| | | | |
|---|---|---|---|
| 4,667,572 | 5/1987 | Elliesen | 227/130 |
| 4,784,308 | 11/1988 | Novak et al. | 227/130 |
| 5,131,579 | 7/1992 | Okushima et al. | 227/130 |
| 5,135,152 | 8/1992 | Uno et al. | 227/130 |
| 5,441,192 | 8/1995 | Sugita et al. | 227/130 |
| 5,485,946 | 1/1996 | Jankel | 227/130 |
| 5,676,300 | 10/1997 | Nakazato et al. | 227/130 |

*Primary Examiner*—Scott A. Smith

*Attorney, Agent, or Firm*—Sughrue, Mion, Zinn, Macpeak & Seas, PLLC

[57] ABSTRACT

A repetitive striking type pneumatically operated nail gun for repeatedly striking, by a drive bit, a head of a nail for sinking the nail into a workpiece. The drive bit is connected to a piston reciprocally movably disposed in a cylinder. A return chamber is provided around the cylinder and in communication therewith. A head valve chamber is provided at a position above a head valve disposed above the cylinder. A drive air is provided for selectively applying compressed air to the head valve chamber or into the cylinder. A repetitive valve chamber is provided for providing selective communication with the return valve, the head valve chamber and a trigger valve. A cylinder guide is provided which prevents the cylinder from being moved in its axial direction in a case where the pressure within the return chamber becomes higher than that in the drive air chamber. A partition segment is provided to the cylinder guide for separating the return chamber from the drive air chamber. Further, an air passage is formed in the cylinder guide for fluidly connecting the repetitive valve chamber to the return chamber.

7 Claims, 7 Drawing Sheets

REPETITIVE STRIKING TYPE PNEUMATICALLY OPERATED NAIL GUN

BACKGROUND OF THE INVENTION

The present invention relates to a repetitive striking type nail gun, and more particularly, to a pneumatically operated nail gun for repeatedly striking, with a drive bit, fasteners such as nails and staples by repetitive reciprocation of a piston during pulling of a trigger.

Throughout the specification, expressions such as "upward," "downward," "above," "below," "upper" and "lower" are used in explanations of conventional art and the present invention to define the various parts when a nail gun is disposed in an orientation for driving a nail downward into a workpiece.

A conventional pneumatically operated repetitive striking type nail gun is disclosed in a Japanese Patent Application Kokai (OPI) No. Hei-2-172682. As shown in FIG. 7, the nail gun includes a main body 101, a handle 136 connected to the main body 101, an exhaust cover 102 provided to the upper portion of the main body 101, and a tail cover 112 provided to a lower portion of the main body 101. A drive air chamber 103 is defined in the main body 101 and the handle 136. The drive air chamber 103 is fluidly connected to a compressed air source (not shown), so that a compressed air is filled in the drive air chamber 103.

Within the main body 101, a cylinder 109 is provided, and a piston 110 is reciprocally and slidably disposed in the cylinder 109. A lower end of the cylinder 109 is in abutment with the lower portion of the main body 101. The piston 110 is integrally provided with a drive bit 111 extending in an axial direction of the cylinder 109.

A generally cylindrical return chamber 104 is defined between the main body 101 and the cylinder 109. At a lower peripheral portion of the cylinder 109, a plurality of return holes 124 are formed, so that the return chamber 104 and the cylinder 109 can be fluidly connected together. Further, at an axially intermediate portion of the cylinder 109, a plurality of communication holes 117 are formed. Radially outer ends of the communication holes 117 are covered by a flexible one-way valve 123, so that air in the cylinder 109 can be discharged toward the return chamber 104 through the communication holes 117, but air in the return chamber 104 cannot be flowed into the cylinder 109 through the communication holes 117.

At a position immediately above the communication holes 117, a first annular flange portion 109A is provided at an outer peripheral surface of the cylinder 109. Further, at the upper portion of the cylinder 109, a second annular flange portion 109B is provided.

A trigger 118 is pivotally movably supported to the main body 101, and a trigger valve 119 is retained in the main body 101. The trigger 118 is abuttable on the trigger valve 119 upon pivotal movement thereof for actuating the trigger valve 119. That is, if the trigger 118 is pulled upwardly, the trigger valve 119 is actuated so that compressed air in an upper head valve chamber 107 (described later) can be discharged to the atmosphere through the trigger valve 119.

In the tail cover 112, a fastener such as a nail can be supplied. Further, a push lever 120 is movably guided by the tail cover 112. The push lever 120 has a lower end in contact with a workpiece surface, and has an upper end engageable with the trigger 118. The upper end of the push lever 120 is normally biased downwardly by a spring 137 interposed between the main body 101 and the upper end of the push lever 120, so that the push lever 120 can provide a locking position of the trigger 118. On the other hand, if the entire tool is pressed downwardly, the workpiece surface pushes the lower end of the push lever 120 upwardly against the biasing force of the spring 137 for releasing the locking state of the trigger 118. The drive bit 111 is extendible into and is guided by the tail cover 112 upon downward movement of the piston 110 for striking the head of the nail supplied in the tail cover 112.

A head valve 105 is slidably disposed relative to the exhaust cover 102 and at a position between the exhaust cover 102 and the upper end of the cylinder 109. The head valve 105 is biased in the axial direction of the cylinder 109 downwardly by a head valve spring 126 interposed between the head valve 105 and the exhaust cover 102, so that the head valve 105 can be seated on the upper open end of the cylinder 109. Further, the upper head valve chamber 107 is defined between the exhaust cover 102 and the head valve 105. The head valve 105 is formed with an air passage 125 which provides fluid communication between the drive air chamber 103 and the upper head valve chamber 107. Further, an exhaust valve 121 is defined at the upper portion of the head valve 105 for discharging compressed air in the cylinder 109 and above the piston 110 when the head valve 105 is moved downwardly.

At a lower surface of the exhaust cover 102, a cylindrical recess is formed for defining a cylindrical repetitive valve chamber 108 in which a repetitive valve 106 is movably provided. An upper surface of the repetitive valve 106 serves a pressure receiving surface whose area is greater than that of the lower surface of the repetitive valve 106. The repetitive valve 106 divides the repetitive valve chamber 108 into a lower repetitive valve chamber 127 and an upper repetitive valve chamber 128.

Further, in the exhaust cover 102, an air passage 114 connecting the upper head valve chamber 107 with the lower repetitive valve chamber 127 is formed. A cross-sectional area of the air passage 125 formed in the head valve 105 is sufficiently smaller than that of the air passages 114 and another air passage 115 (described later). One open end of the air passage 114 faces the lower surface of the repetitive valve 106.

Between the exhaust cover 102 and the second flange 109B of the cylinder 109, a spacer or a cylinder guide 122 is fixedly positioned. More specifically, a packing 131 is provided between the exhaust cover 102 and the upper end of the main body 101. The cylinder guide 122 has an upper end 122A in abutment with the packing 131, a sleeve portion 122B extending along the inner peripheral surface of the main body 101, and a lower portion 122C in abutment with the second flange portion 109B of the cylinder 109. With this arrangement, an axially movement of the cylinder 109 can be prevented by the abutment between the lower portion 122C and the second flange 109B. More specifically, if the cylinder guide 122 is not provided, the cylinder 109 may be vibrated in its axial direction at every reciprocation. As a result, air inlet opening area between the upper open end of the cylinder 109 and the head valve 105 may be varied, so that the pressure applied to the cylinder 109 and above the piston 110 becomes changed at every striking operation. Accordingly, the nail cannot be desirably driven into the workpiece. To avoid this problem, the above described spacer or the cylinder guide 122 is provided to avoid axial movement of the cylinder 109.

Further, a radially inward annular projection 113 is provided integrally with the main body 101 at a position in contact with the first flange 109A. This annular projection 113 serves as a partition member for partitioning the return chamber 104 from the drive air chamber 103.

Further, the air passage 115 is provided for fluidly connecting the lower repetitive valve chamber 127 with the trigger valve 119. Thus, the air passages 114 and 115 provide a fluid communication between the upper head valve chamber 107 and the trigger valve 119 provided that the repetitive valve 106 maintains its upper position. Furthermore, an elongated air passage 116 is provided in the main body 101 for fluidly connecting the upper repetitive valve chamber 128 with the return chamber 104.

In operation, if the lowermost end of the push lever 120 is pressed against the workpiece, the uppermost end of the push lever 120 releases the lock of the trigger 118. With this state, if the trigger 118 is pulled upwardly, the upper head valve chamber 107 is brought into communication with the atmosphere through the air passage 114, the lower repetitive valve chamber 127, the air passage 115 and the trigger valve 119. Therefore, the compressed air in the upper head valve chamber 107 is discharged to the atmosphere out of the trigger valve 119.

Accordingly, the head valve 105 is moved upwardly, so that the upper open end of the cylinder 109 is opened. Consequently, driving air in the drive air chamber 103 is flowed into the cylinder 109 and rapidly urges the piston 110 downwardly. Because the drive bit 111 is provided integrally with the piston 110, the nail in the tail cover 112 is driven into the workpiece.

In this downward stroke of the piston 110, the air in the cylinder 109 and below the piston 110 is flowed into the return chamber 104 through the return hole 124, and is compressed in the return chamber 104. Further in the downward stroke, if the piston 110 moves past the communication hole 117, the compressed air in the cylinder 109 and above the piston 110 is also flowed into the return chamber 104 through the communication hole 117.

The compressed air flowed into the return chamber 104 will be flowed into the upper repetitive valve chamber 128 through the air passage 116. In this state, because atmospheric pressure is applied in the lower repetitive valve chamber 127 through the trigger valve 119 and the air passage 115, the repetitive valve 106 is urged downwardly so that the repetitive valve 106 is seated on the open end of the air passage 114. Thus, fluid communication between the air passages 114 and 115 is shut off. That is, the upper head valve chamber 107 is shut off from the atmosphere.

Because the upper head valve chamber 107 is communicated with the drive air chamber 103 through the air passage 125, application of the compressed air in the drive air chamber 103 into the upper head valve chamber 107 will increase pneumatic pressure in the upper head valve chamber 107 and in the air passage 114. Here, the lower surface of the repetitive valve 106 has a pressure receiving area smaller than that of the upper surface of the repetitive valve 106, and therefore, the repetitive valve 106 maintains its downward position for a given period, i.e., the communication between the air passages 114 and 115 is maintained in shut off state in spite of the pressure increase in the upper head valve chamber 107.

In accordance with the increase in pneumatic pressure in the upper head valve chamber 107, the head valve 105 is moved downwardly in cooperation with the biasing force of the head valve spring 126, and as a result, the head valve 105 is seated on the upper open end of the cylinder 109, whereby fluid communication between the drive air chamber 103 and the cylinder 109 is blocked. At the same time, compressed air in the cylinder 109 and above the piston 110 is discharged to the atmosphere through the discharge valve 121, because the discharge port is opened upon downward movement of the head valve 105. Accordingly, the piston 110 can be returned to its original top dead center position because of the application of the compressed pressure to the cylinder 109 and below the piston 110 from the return chamber 104 through the return hole 124.

The compressed air in the return chamber 104 is also discharged to the atmosphere through the minute gap between the drive bit 111 and the tail cover 112. Further, because of the expansion of the compressed air, the pneumatic pressure in the return chamber 104 is lowered, and therefore, the pressure applied to the upper repetitive valve chamber 128 through the air passage 116 is also lowered. Accordingly, the repetitive valve 106 is moved upwardly because of the pressure applied to the lower repetitive valve chamber 127 from the upper head valve chamber 107.

By the upward movement of the repetitive valve 106, the head valve chamber 107 is brought into communication with the atmosphere through the air passage 114, the lower repetitive valve chamber 127, the air passage 115 and the trigger valve 119. Thus, the compressed air in the upper head valve chamber 107 and in the air passage 114 can be discharged to the atmosphere out of the trigger valve 119.

Because the cross-sectional area of the air passage 125 is sufficiently smaller than that of the air passages 114 and 115, compressed air flowing amount into the upper head valve chamber 107 from the drive air chamber 103 through the air passage 125 is smaller than the air discharge amount from the upper head valve chamber 107 to the atmosphere through the air passages 114, 115 and the trigger valve 119. As a result, pressure in the upper head valve chamber 107 is rapidly lowered.

Thus, the head valve 105 is again moved upwardly to introduce the driving air in the drive air chamber 103 into the cylinder 109 to perform second striking or driving operation. The above described operation is consequentially and repeatedly performed so that the nail is subjected to repeated striking by the drive bit 111 as far as the trigger 118 is maintained in its pulling state.

With the conventional arrangement, the air passage 116 largely extends through the main body, and therefore, large machining area results. Further, since the radially inward annular projection 113 is provided integrally with the main body 101. Therefore, the radially inward annular projection 113 may become an undercut in die-casting or injection molding process. Therefore, the main body 101 would not be available as the die-casting molding product.

To avoid this problem, as shown in FIG. 8, a separate partitioning piece 213 can be hermetically provided at the hollow cylindrical space between a main body 201 and a cylinder 109. However, a fixing member such as a stop washer 240 is required for fixing the position of the separate partitioning piece 213.

Further, instead of the radially inward annular projection 113 provided to the main body 101, a corresponding partitioning segment can be integrally provided to the outer peripheral surface of the cylinder 109 at a position corresponding to the first annular flange 109A. However, in the latter case, the radially outward protruding length of the partitioning segment becomes large. Therefore, an original crude cylinder before machining must provide a large diameter, and machining labor is also increased, to degrade productivity.

SUMMARY OF THE INVENTION

It is therefore, an object of the present invention to overcome the above-described drawbacks and disadvantages, and to provide an improved repetitive striking type nail gun which can be provided with a reduced number of mechanical parts, with a reduced machining, and with a reduced breakdown.

This and other objects of the present invention will be attained by a pneumatically operated gun for repeatedly striking a fastener for driving the fastener into a workpiece including a main body, a drive air chamber, a cylinder, a piston, a drive bit, a head valve, a head valve chamber section, a repetitive valve, a trigger valve, a return chamber section, first through third passage means, and a cylinder guide. The drive air chamber section is provided in the main body and accumulates therein a compressed air. The cylinder is disposed in the main body and has an axis and an upper open end. The piston is reciprocally movably disposed in the cylinder. The drive bit is provided to the piston and extends in a direction of the axis of the cylinder. The drive bit strikes the fastener in a downward movement of the piston. The head valve is provided above the upper open end of the cylinder. The head valve is movable to contact with the upper open end for shutting off a fluid communication between the drive air chamber and the cylinder above the piston and for discharging compressed air in the cylinder above the piston to an atmosphere and is movable away from the upper open end for providing fluid communication between the cylinder above the piston and the drive air chamber. The head valve chamber section is positioned above the head valve. The repetitive valve controls repetitive movement of the head valve for performing repeated striking operation of the drive bit in interlocking relation with the movement of the head valve. The trigger valve controls movement of the head valve. The return chamber section is disposed in the main body and in communication with the cylinder below the piston. The first passage means communicates the return chamber section with the repetitive valve for applying a pneumatic pressure in the return chamber section to the repetitive valve. The second passage means communicates the head valve chamber section with the repetitive valve. The third passage means communicates the repetitive valve with the trigger valve for selectively communicating the head valve chamber section with the trigger valve in accordance with the movement of the repetitive valve. The cylinder guide is fixedly disposed at a position immediately above the cylinder and in abutment therewith for preventing the cylinder from being moved in its axial direction. The first passage means is formed in the cylinder guide.

DETAILED DESCRIPTION OF THE PREFERRED EMBODIMENTS

Figure 1:
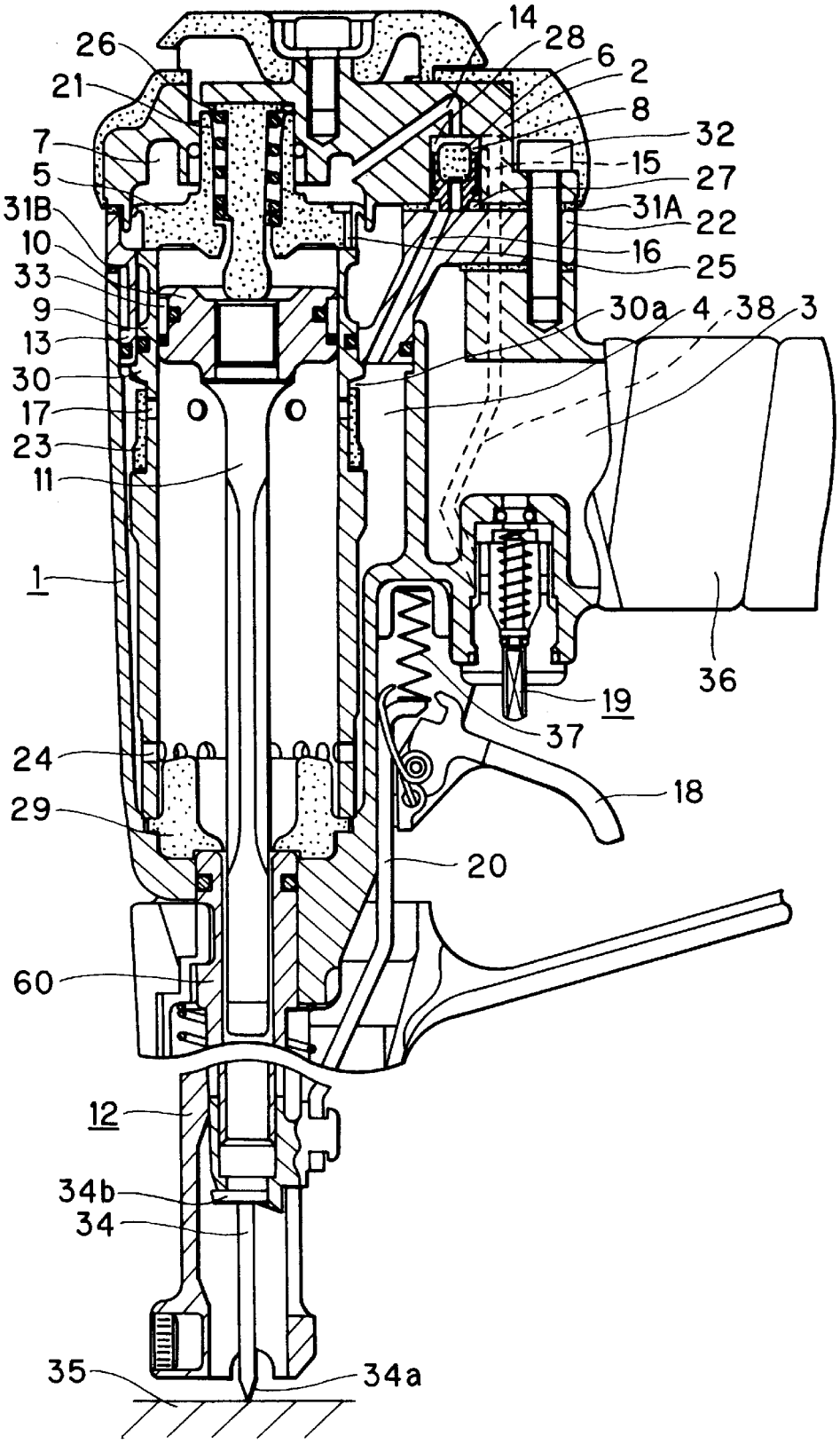
FIG. 1 is a longitudinal cross-sectional view showing a repetitive striking type nail gun in a non-firing mode according to a first embodiment of the present invention.

A pneumatically operated repetitive striking type nail gun according to a first embodiment of the present invention will be described with reference to FIGS. 1 through 4.

The nail gun includes a main body 1, a handle 36 connected to the main body 1, an exhaust cover 2 provided to the upper portion of the main body 1, and a tail cover 12 provided to a lower portion of the main body 1. A drive air chamber 3 is defined in the main body and the handle 36. The drive air chamber 3 is fluidly connected to a compressed air source (not shown), so that a compressed air is filled in the drive air chamber 3.

Within the main body 1, a cylinder 9 is provided, and a piston 10 assembled with a piston ring 33 is reciprocally and slidably disposed in the cylinder 9. At the lower portion of the main body 1, a piston bumper 29 is provided so that the piston 10 can be brought into abutment therewith during downward moving stroke thereof. The lower end of the cylinder 9 is in abutment with the lower portion of the main body 1 via the piston bumper 29. The piston 10 is integrally provided with a drive bit 11 extending in an axial direction of the cylinder 9.

A generally cylindrical return chamber 4 is defined between the main body 1 and the cylinder 9. At a lower peripheral portion of the cylinder 9, and at a position immediately above the piston bumper 29, a plurality of return holes 24 are formed, so that the return chamber 4 and the cylinder 9 can be fluidly connected together. Further, at an axially intermediate and upper portion of the cylinder 9, a large diameter portion 30 is provided. The large diameter portion 30 is provided by an annular projection projecting radially outwardly from the outer peripheral surface of the cylinder 9. The large diameter portion 30 is formed with an annular recess 30*a* at which a plurality of communication holes 17 are formed. Radially outer ends of the communication holes 17 are covered by a flexible one-way valve 23, so that air in the cylinder 9 can be discharged toward the return chamber 4 through the communication holes 17, but air in the return chamber 4 cannot be flowed into the cylinder 9 through the communication holes 17.

A trigger 18 is pivotally movably supported to the main body 1, and a trigger valve 19 is retained in the main body 1. The trigger 18 is abuttable on the trigger valve 19 upon pivotal movement thereof for actuating the trigger valve 19. That is, if the trigger 18 is pulled upwardly, the trigger valve 19 is actuated so that compressed air in an upper head valve chamber 7 (described later) can be discharged to the atmosphere through the trigger valve 19.

A fastener such as a nail 34 to be driven into a workpiece 35 can be inserted through the lowermost opening of the tail cover 12. Further, a push lever 20 is movably guided by the tail cover 12. The push lever 20 has a lower end in contact with a head 34*b* of the nail 34, and has an upper end engageable with the trigger 18. The upper end of the push lever 20 is normally biased downwardly by a spring 37 interposed between the main body 1 and the upper end of the push lever 20, so that the push lever 20 can provide a locking position of the trigger 18. On the other hand, if the entire tool is pressed downwardly, the head 34*b* of the nail 34 pushes the lower end of the push lever 20 upwardly against the biasing force of the spring 37 for releasing the locking state of the trigger 18. The drive bit 11 is extendible into and is guided by the tail cover 12 upon downward movement of the piston 10 for striking the head 34*b* of the nail 34 positioned in the tail cover 12.

A head valve 5 is slidably disposed relative to the exhaust cover 2 and at a position between the exhaust cover 2 and the upper end of the cylinder 9. The head valve 5 is biased in the axial direction of the cylinder 9 downwardly by a head valve spring 26 interposed between the head valve 5 and the exhaust cover 2, so that the head valve 5 can be seated on the upper open end of the cylinder 9. Further, the upper head valve chamber 7 is defined between the exhaust cover 2 and the head valve 5. The head valve 5 is formed with an air passage 25 which provides fluid communication between the drive air chamber 3 and the upper head valve chamber 7. Further, an exhaust valve 21 is defined at the upper portion of the head valve 5 for discharging compressed air in the cylinder 9 and above the piston 10 when the head valve 5 is moved downwardly. Thus, if the head valve 5 is moved upwardly against the biasing force of the head valve spring 26, the upper end of the cylinder 9 is opened, so that the drive air chamber 3 and the cylinder 9 above the piston 10 is communicated with each other, and at the same time, the exhaust valve 21 is closed. On the other hand, if the head valve 5 is moved downwardly, the upper open end of the cylinder 9 is closed so that the cylinder 9 is shut off from the drive air chamber 3, and at the same time, the exhaust valve 21 is opened to discharge the compressed air in the cylinder 9 above the piston 10.

At a lower surface of the exhaust cover 2, a cylindrical recess is formed for defining a cylindrical repetitive valve chamber 8 in which a repetitive valve 6 is movably provided. An upper surface of the repetitive valve 6 serves a pressure receiving surface whose area is smaller than that of the lower surface of the repetitive valve 6. The repetitive valve 6 divides the repetitive valve chamber 8 into a lower repetitive valve chamber 27 and an upper repetitive valve chamber 28.

Further, in the exhaust cover 2, an air passage 14 connecting the upper head valve chamber 7 with the upper repetitive valve chamber 28 is formed. A cross-sectional area of the air passage 25 formed in the head valve 5 is sufficiently smaller than that of the air passages 14 and another air passage 15(described later). One open end of the air passage 14 faces the upper surface of the repetitive valve 6.

Between the exhaust cover 2 and the upper end of the main body 1, a cylinder guide 22 is fixedly positioned. A packing 31A is interposed between the lower end face of the exhaust cover 2 and the upper surface of the cylinder guide 22, and a second packing 31B is interposed between the lower face of the cylinder guide 22 and the upper end of the main body 1. The lower boundary of the repetitive valve chamber 8 is thus defined by the cylindrical guide 22. A bolt 32 extends through and is threadingly engaged with the exhaust cover 2, the cylinder guide 22 and the main body 1, so that the cylinder guide 22 is firmly fixed to the main body 1 in cooperation with the exhaust cover 2.

Figure 4:
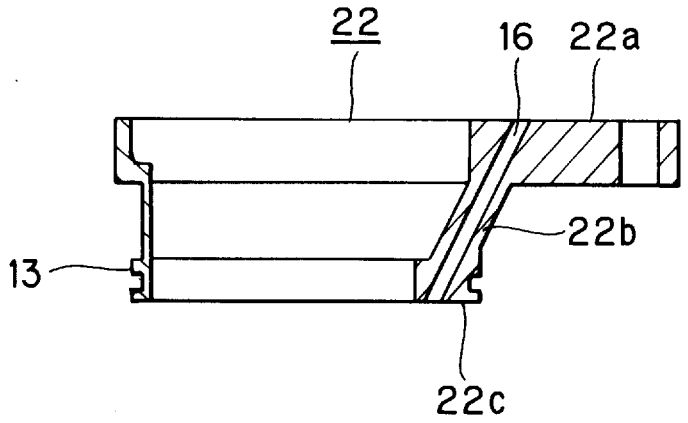
FIG. 4 is a cross-sectional view showing a cylinder guide used in the first embodiment.

As also shown in FIG. 4, the cylinder guide 22 includes an upper portion or a top deck portion 22*a*, an intermediate leg portion 22*b*, and a lower portion 22*c*. The top deck portion 22*a* is in intimate contact with the exhaust cover 2 and defines a part of the lower repetitive valve chamber 27. The lower portion 22*c* is provided with a partition wall 13 which prevents the fluid communication between the return chamber 4 and the drive air chamber 3.

Further, the lower portion 22*c* is engaged with the large diameter portion 30 of the cylinder 9. Because the cylinder guide 22 is firmly fixed to the main body 1 by the bolt 32, the cylinder 9 is firmly fixed by the cylinder guide 22. Thus, the cylinder guide 22 prevents the cylinder 9 from being moved in its axial direction.

Throughout the intermediate leg portion 22*b* and the upper and lower portions 22*a* and 22*c*, an air passage 16 is formed. Therefore, one end of the air passage 16 is open to the return chamber 4, and other end of the air passage 16 is open to the lower repetitive valve chamber 27. That is, the lower surface of the repetitive valve 6 confronts the other open end of the air passage 16.

Further, the air passage 15 is formed through the exhaust cover 2, the cylinder guide 22 and the main body 1. (In the drawings, an air passage 38 is shown, which is a passage formed in the main body 1, so that the air passage 15 is fluidly connected to the trigger valve 19.) Thus, the air passage 15 provides a continuous air passage having one end open to the upper repetitive valve chamber 28 and another end open to the trigger valve 19. Incidentally, specific sealing arrangement is not required at a position between the lower open end of the air passage 16 and the return chamber 4, and at a position between the upper open end of the air passage 16 and the lower repetitive valve chamber 27. The air passage 16 can be easily formed in the cylinder guide 22 by a simple machining.

In operation as shown in FIG. 1, if the nail 34 is inserted into the tail cover 12, and nail gun is pressed against the workpiece 35, the tip end 34*a* of the nail 34 is presses the workpiece 35, so that the lowermost end of the push lever 20 in contact with the head 34*b* of the nail 34 is pushed upwardly by the nail 34. As a result, the uppermost end of the push lever 20 releases the lock of the trigger 18.

Figure 2:
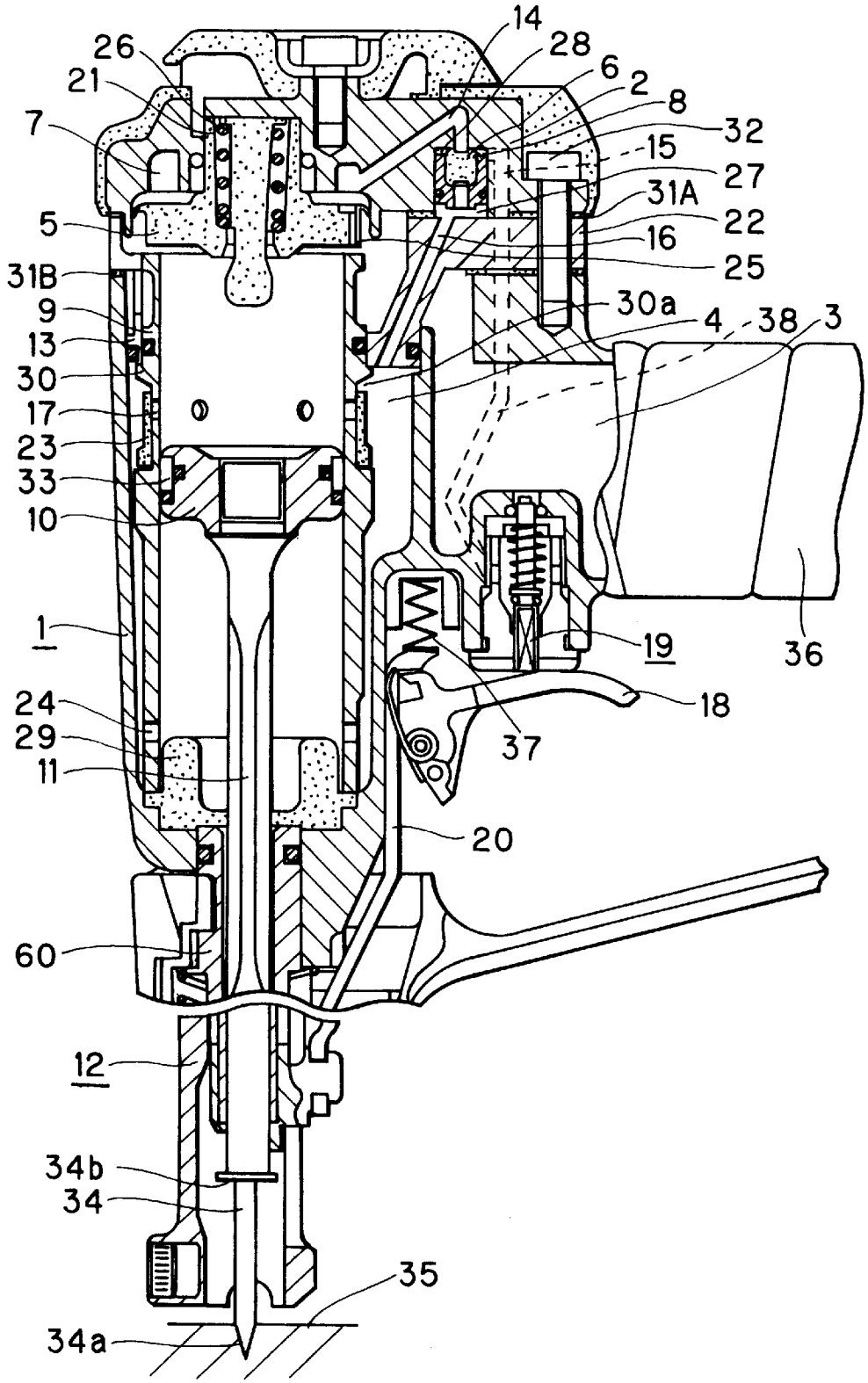
FIG. 2 is a longitudinal cross-sectional view showing the nail gun in a firing mode in which a piston is moved to its lower position according to the first embodiment.

With this state, if the trigger 18 is pulled upwardly, the upper head valve chamber 7 is brought into communication with the atmosphere through the air passage 14, the upper repetitive valve chamber 8, the air passage 15 and the trigger valve 19. Therefore, the compressed air in the upper head valve chamber 7 is discharged to the atmosphere out of the trigger valve 19. Accordingly, the head valve 5 is moved upwardly, so that the upper open end of the cylinder 9 is opened. Consequently, driving air in the drive air chamber 3 is flowed into the cylinder 9 and rapidly urges the piston 10 downwardly as shown in FIG. 2. Because the drive bit 11 is provided integrally with the piston 10, the nail 34 in the tail cover 12 is driven into the workpiece 35.

In this downward stroke of the piston 10, the air in the cylinder 9 and below the piston 10 is flowed into the return chamber 4 through the return hole 24, and is compressed in the return chamber 4. Further in the downward stroke, if the piston 10 moves past the communication hole 17, the compressed air in the cylinder 9 and above the piston 10 is also flowed into the return chamber 4 through the communication hole 17.

The compressed air flowed into the return chamber 4 will be flowed into the lower repetitive valve chamber 27 through the air passage 16. In this state, because atmospheric pressure is applied in the upper repetitive valve chamber 8 through the trigger valve 19 and the air passage 15, the repetitive valve 6 is urged upwardly so that the repetitive valve 6 is seated on the open end of the air passage 14. Thus, fluid communication between the air passages 14 and 15 is shut off. That is, the upper head valve chamber 7 is shut off from the atmosphere.

Because the upper head valve chamber 7 is communicated with the drive air chamber 3 through the air passage 25, application of the compressed air in the drive air chamber 3 into the upper head valve chamber 7 will increase pneumatic pressure in the upper head valve chamber 7 and in the air passage 14. Here, the upper surface of the repetitive valve 6, the upper surface confronting the open end of the air passage 14 has a pressure receiving area smaller than that of the lower surface of the repetitive valve 6, the lower surface confronting the open end of the air passage 16. Therefore, the repetitive valve 6 maintains its elevated position for a given period, i.e., the communication between the air passages 14 and 15 is maintained in shut off state in spite of the pressure increase in the upper head valve chamber 7.

Figure 3:
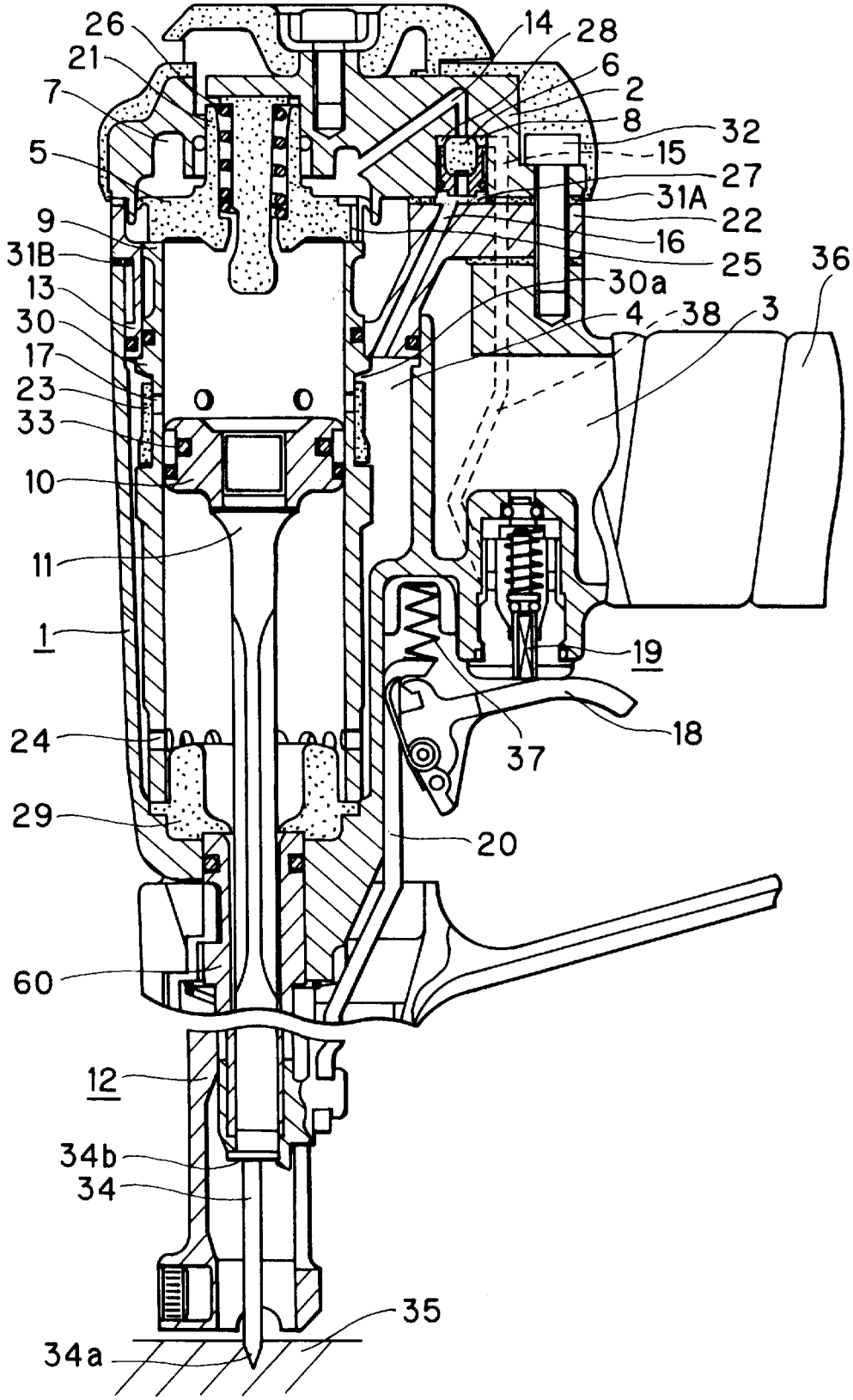
FIG. 3 is a longitudinal cross-sectional view showing the nail gun in the firing mode and the piston is moved to its uppermost position according to the first embodiment.

In accordance with the increase in pneumatic pressure in the upper head valve chamber 7, the head valve 5 is moved downwardly in cooperation with the biasing force of the head valve spring 26, and as a result, the head valve 5 is seated on the upper open end of the cylinder 9, whereby fluid communication between the drive air chamber 3 and the cylinder 9 is blocked. At the same time, compressed air in the cylinder 9 and above the piston 10 is discharged to the atmosphere through the discharge valve 21, because the discharge port is opened upon downward movement of the head valve 5. Accordingly, the original 10 can returned to its original top dead center position as shown in FIG. 3 because of the application of the compressed pressure to the cylinder 9 and below the piston 10 from the return chamber 4 through the return hole 24.

The compressed air in the return chamber 4 is also discharged to the atmosphere through the minute gap between the drive bit 11 and the tail cover 12. Further, because of the expansion of the compressed air, the pneumatic pressure in the return chamber 4 is lowered, and therefore, the pressure applied to the lower repetitive valve chamber 27 through the air passage 16 is also lowered. Accordingly, the repetitive valve 6 is moved downwardly because of the pressure applied to the upper repetitive valve chamber 8 from the upper head valve chamber 7.

By the downward movement of the repetitive valve 6, the head valve chamber 7 is brought into communication with the atmosphere through the air passage 14, the upper repetitive valve chamber 8, the air passage 15 and the trigger valve 19. Thus, the compressed air in the upper head valve chamber 7 and in the air passage 14 can be discharged to the atmosphere out of the trigger valve 19.

Because the cross-sectional area of the air passage 25 is sufficiently smaller than that of the air passages 14 and 15, compressed air flowing amount into the upper head valve chamber 7 from the drive air chamber 3 through the air passage 25 is smaller than the air discharge amount from the upper head valve chamber 7 to the atmosphere through the air passages 14, 15 and the trigger valve 19. As a result, pressure in the upper head valve chamber 7 is rapidly lowered.

Thus, as described above, the head valve 5 is again moved upwardly to introduce the driving air in the drive air chamber 3 into the cylinder 9 to perform second striking or driving operation. The above described operation is consequentially and repeatedly performed so that the nail 34 is subjected to repeated striking by the drive bit 11 as far as the trigger 113 is maintained in its pulling state.

As described above, when the piston 10 downwardly moves past the communication hole 17, the compressed air in the cylinder 9 and above the piston 10 is flowed into the return chamber 4 through the communication hole 17. In this case, due to the repetitive striking operation, the pneumatic pressure in the return chamber 4 may be higher than that in the drive air chamber 3. This is due to the fact that by the time the piston 10 begins its downward movement after the piston has returned to its uppermost position, the compressed air in the return chamber 4 cannot be completely discharged to the atmosphere through the gap between the drive bit 11 and the tail cover 12, and increased amount of air is compressed in the return chamber 4 by the downward movement of the piston 10. Normally, the cylinder 9 is urged downwardly by the pressure from the drive air chamber 3, i.e., in a direction away from the head valve 5. However, if the pressure in the return chamber 4 becomes higher than the pressure in the drive air chamber 3, the cylinder 9 is urged upwardly, i.e., toward the head valve 5. If reciprocal motion of the piston 10 is repeatedly performed for repeating the striking operation, this downward and upward urging forces is alternately applied to the cylinder 9, so that the cylinder 9 itself may be reciprocated in its axial direction if the cylinder guide 22 is not provided.

Because the upper end of the cylinder 9 faces the drive air chamber 3 whereas the lower end of the cylinder 9 faces the return chamber 4, the cylinder 9 is urged axially upwardly due to the pressure differential. However, the large diameter portion 30 of the cylinder 9 is in contact with the cylinder guide 22, and the cylinder guide 22 is firmly fixed to the main body 1 by the exhaust cover 2 and the bolt 32. Therefore, the cylinder 9 cannot be moved upwardly but is maintained in its stationary position. Accordingly, the distance between the upper end of the cylinder 9 and the head valve 5 can be maintained at a predetermined distance when the head valve 5 is at its elevated position thereby providing a constant air inlet opening area from the drive air chamber 3 into the cylinder 9. Moreover, the partition wall 13 provided at the lower end portion 22*c* of the cylinder guide 22 is also maintained at its stationary position.

Further, the air passage 16 communicating the return chamber 4 with the repetitive valve chamber 8 is formed in the cylinder guide 22, and the lower portion 22*c* of the cylinder guide 22 serves to partition the return chamber 4 from the drive air chamber 3, and further, the repetitive valve chamber 8 is provided at the upper portion of the cylinder guide 22. Therefore, number of parts or mechanical components can be reduced, and machining process can be reduced, thereby enhancing productivity and lowering probability of mechanical break down.

Figure 5:
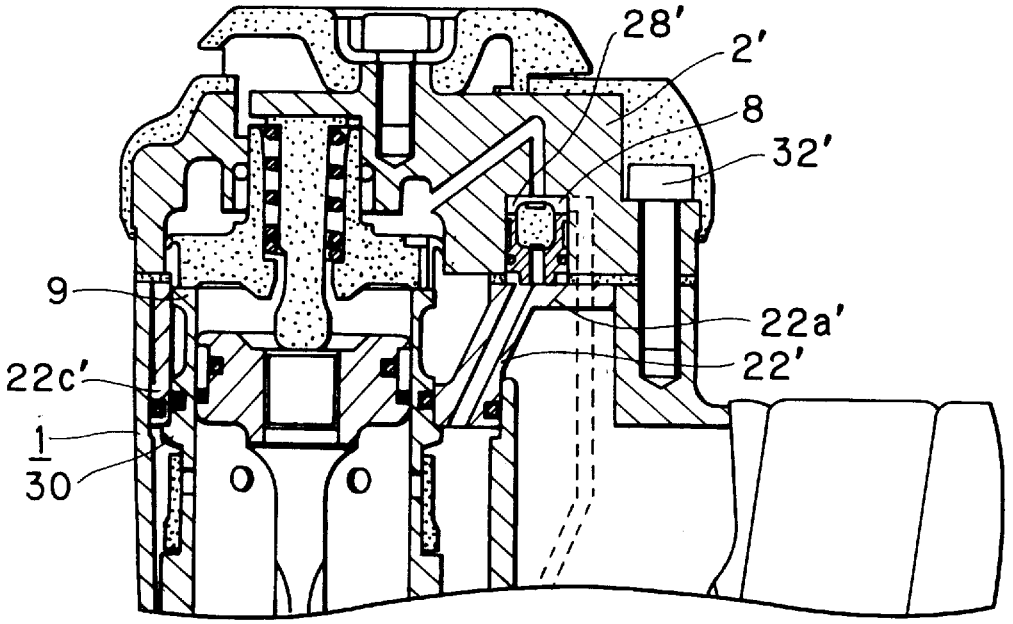
FIG. 5 is a partial cross-sectional view showing a repetitive striking type nail gun according to a second embodiment of the present invention.

A pneumatically operated repetitive striking type nail gun according to a second embodiment of the present invention will be described with reference to FIG. 5.

In the first embodiment, the top deck portion 22*a* of the cylinder guide 22 is interposed between the exhaust cover 2 and the main body 1, and is threadingly engaged with the bolt 32 extending therethrough. In contrast, in the second embodiment, the exhaust cover 2' is directly fixed to the main body 1 by a bolt 32' without the interposition of the top deck 22*a'* of the cylinder guide 22'. An upper surface of a top deck 22*a'* is merely in contact with the lower surface of the exhaust cover 2, and outer peripheral surface of the top deck 22*a'* is merely in contact with an inner peripheral surface of the main body 1. With this arrangement, because the lower portion 22*c'* of the cylinder guide 22 is engaged with the large diameter portion 30 of the cylinder 9, the axially upward movement of the cylinder 9 can be prevented by the cylinder guide 22'. With this arrangement, entire length of the nail gun in the axial direction of the cylinder 9 can be reduced by the thickness of the top deck portion 22*a'*.

Figure 6:
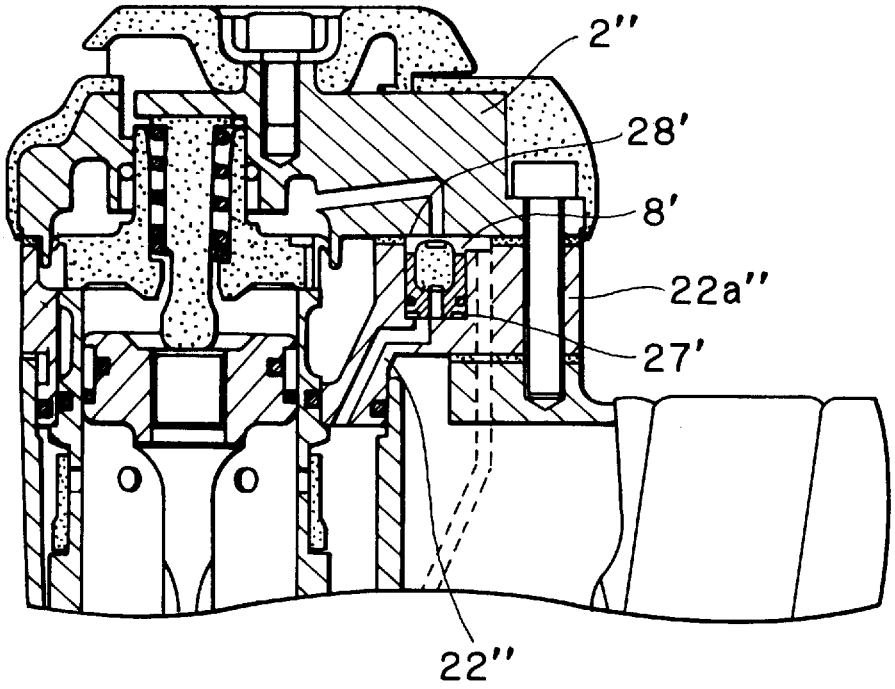
FIG. 6 is a partial cross-sectional view showing a repetitive striking type nail gun according to a third embodiment of the present invention.
Figure 7:
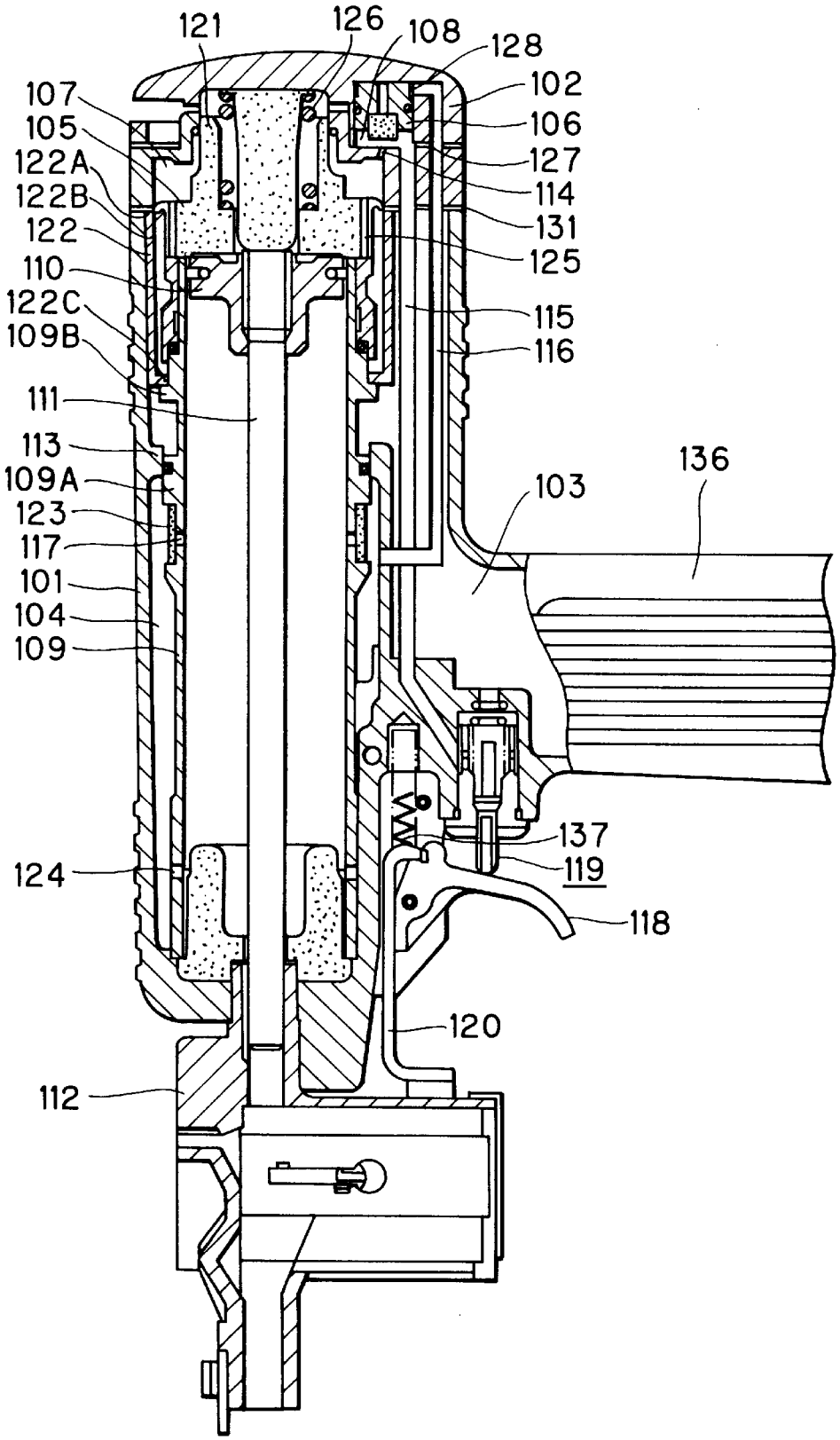
FIG. 7 PRIOR ART
FIG. 7 is a longitudinal cross-sectional view showing a conventional repetitive striking type nail gun.
Figure 8:
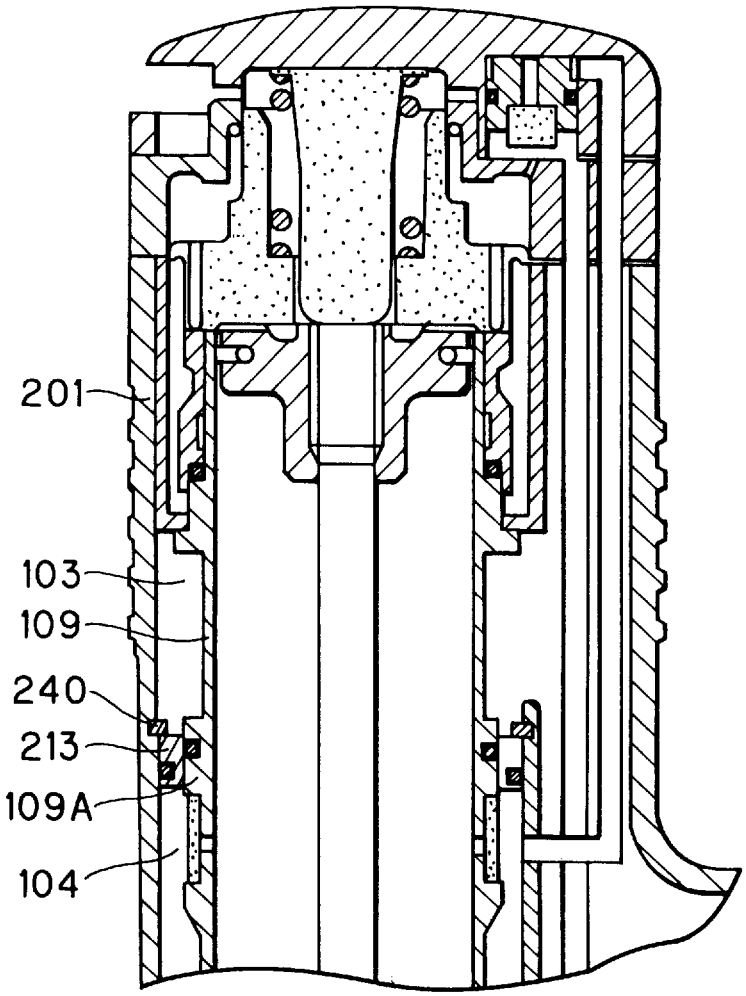
FIG. 8 PRIOR ART
FIG. 8 is a longitudinal cross-sectional view showing another conventional repetitive striking type nail gun.

FIG. 6 shows a third embodiment of the pneumatically operated repetitive striking type nail gun. In this embodiment, no cylindrical recess is formed in the exhaust cover 2" to provide a repetitive valve chamber. Instead, the repetitive valve chamber 8' is formed in a top deck portion 22*a*" of a cylinder guide 22". That is, the lower surface of the exhaust cover 2" defines an upper repetitive valve chamber 28', and a lower repetitive valve chamber 27' is defined within the top deck portion 22*a*". Operation and attendant effect is the same as those of the first embodiment.

While the invention has been described in detail and with reference to the specific embodiments thereof, it would be apparent to those skilled in the art that various changes and modifications may be made therein without departing from the spirit and scope of the invention.

What is claimed is:

1. A pneumatically operated gun for repeatedly striking a fastener for driving the fastener into a workpiece comprising;

a main body;

a drive air chamber section provided in the main body and accumulating therein a compressed air;

a cylinder disposed in the main body and having an axis and an upper open end;

a piston reciprocally movably disposed in the cylinder;

a drive bit provided to the piston and extending in a direction of the axis of the cylinder, the drive bit striking the fastener in a downward movement of the piston;

a head valve provided above the upper open end of the cylinder, the head valve being movable to contact with the upper open end for shutting off a fluid communication between the drive air chamber and the cylinder above the piston and for discharging compressed air in the cylinder above the piston to an atompshere and movable away from the upper open end for providing fluid communication between the cylinder above the piston and the drive air chamber;

a head valve chamber section positioned above the head valve;

a repetitive valve controlling repetitive movement of the head valve for performing repeated striking operation of the drive bit in interlocking relation with the movement of the head valve;

a trigger valve controlling movement of the head valve;

a return chamber section disposed in the main body and in communication with the cylinder below the piston;

a first passage means communicating the return chamber section with the repetitive valve for applying a pneumatic pressure in the return chamber to the repetitive valve;

a second passage means communicating the head valve chamber section with the repetitive valve;

a third passage means communicating the repetitive valve with the trigger valve for selectively communicating the head valve chamber section with the trigger valve in accordance with the movement of the repetitive valve; and a cylinder guide fixedly disposed at a position immediately above the cylinder and in abutment therewith for preventing the cylinder from being moved in its axial direction, the first passage means being formed in the cylinder guide.

2. The pneumatically operated gun as claimed in claim 1, wherein the cylinder guide has an upper deck section fixed to or seated on the main body, and a lower portion in abutment with the cylinder, the lower portion being provided with a partitioning segment separating the return chamber section from the drive air chamber section.

3. The pneumatically operated gun as claimed in claim 2, further comprising an exhaust cover disposed above the head valve and fixedly secured to the main body, the head valve chamber section being defined between the exhaust cover and the head valve;

and wherein the upper deck section is fixedly interposed between the exhaust cover and the main body.

4. The pneumatically operated gun as claimed in claim 3, wherein the exhaust cover has a lower portion formed with a recess defining a repetitive valve chamber section in which the repetitive valve is disposed, the repetitive valve dividing the repetitive valve chamber into an upper repetitive valve chamber and a lower repetitive valve chamber, the upper repetitive valve chamber being in communication with the head valve chamber section by way of the second passage means and with the trigger valve by way of the third passage means, and the lower repetitive valve chamber section being in communication with the return chamber section by way of the first passage means.

5. The pneumatically operated gun as claimed in claim 3, wherein the top deck portion of the cylinder guide is formed with a recess defining a repetitive valve chamber section in which the repetitive valve is disposed, the repetitive valve dividing the repetitive valve chamber into an upper repetitive valve chamber facing the exhaust cover and a lower repetitive valve chamber, the upper repetitive valve chamber being in communication with the head valve chamber section by way of the second passage means and with the trigger valve by way of the third passage means, and the lower repetitive valve chamber section being in communication with the return chamber section by way of the first passage means.

6. The pneumatically operated gun as claimed in claim 2, further comprising an exhaust cover disposed above the head valve and fixedly secured to the main body, the head valve chamber section being defined between the exhaust cover and the head valve;

and wherein the upper deck section has an upper surface in intimate contact with a lower surface of the exhaust cover.

7. The pneumatically operated gun as claimed in claim 6, wherein the exhaust cover has a lower portion formed with a recess defining a repetitive valve chamber section in which the repetitive valve is disposed, the repetitive valve dividing the repetitive valve chamber into an upper repetitive valve chamber and a lower repetitive valve chamber, the upper repetitive valve chamber being in communication with the head valve chamber section by way of the second passage means and with the trigger valve by way of the third passage means, and the lower repetitive valve chamber section being in communication with the return chamber section by way of the first passage means.

* * * * *